US005118311A

United States Patent [19]

Margini

[11] Patent Number: 5,118,311

[45] Date of Patent: Jun. 2, 1992

[54] TWO-PART SOCKET UNIT FOR A MODULAR JACK ASSEMBLY

[75] Inventor: Sergio Margini, Cassano D'Adda, Italy

[73] Assignee: E. I. Du Pont de Nemours and Company, Wilmington, Del.

[21] Appl. No.: 676,063

[22] Filed: Mar. 27, 1991

[30] Foreign Application Priority Data

Mar. 27, 1990 [NL] Netherlands ..... 9000721

[51] Int. Cl.[5] ..... H01R 23/02

[52] U.S. Cl. ..... 439/676; 439/344

[58] Field of Search ..... 439/676, 78, 79, 344, 439/686, 687, 689, 695, 696, 701

[56] References Cited

U.S. PATENT DOCUMENTS

| | | | |
|---|---|---|---|
| 3,860,318 | 1/1975 | Reavis, Jr. et al. | 339/99 |
| 4,202,593 | 5/1980 | Abernethy et al. | 339/125 |
| 4,458,973 | 7/1984 | Hayes et al. | 339/91 |
| 4,461,523 | 7/1984 | Ustin et al. | 339/41 |
| 4,473,265 | 9/1984 | Dellinger et al. | 339/39 |
| 4,497,526 | 2/1985 | Myers | 339/17 |
| 4,520,558 | 6/1985 | Bunnell | 29/749 |
| 4,527,856 | 7/1985 | Webb et al. | 439/676 |
| 4,572,602 | 2/1986 | Rupnik | 339/65 |
| 4,580,859 | 4/1986 | Frano et al. | 339/91 |
| 4,624,516 | 11/1986 | White | 339/40 |
| 4,698,025 | 10/1987 | Silbernagel et al. | 439/79 |
| 4,703,991 | 11/1987 | Philippson | 439/676 |
| 4,713,016 | 12/1987 | Kato | 439/137 |
| 4,717,358 | 1/1988 | Chaundy | 439/557 |
| 4,725,249 | 2/1988 | Blackwood et al. | 439/535 |
| 4,738,629 | 4/1988 | Newman | 439/137 |
| 4,749,370 | 6/1988 | Moser et al. | 439/460 |
| 4,756,695 | 7/1988 | Lane et al. | 439/76 |
| 4,786,259 | 11/1988 | Paul | 439/344 |
| 4,915,655 | 4/1990 | Tanaka | 439/676 |

FOREIGN PATENT DOCUMENTS

| | | | |
|---|---|---|---|
| 1246703 | 12/1988 | Canada | 439/676 |
| 0157513 | 10/1985 | European Pat. Off. . | |
| 2157096 | 3/1985 | United Kingdom . | |

*Primary Examiner*—David L. Pirlot

[57] ABSTRACT

A two-part socket unit for receiving and contacting a plug unit of a modular jack assembly of the type for fitting near an edge of a printed circuit board. The socket unit comprises an approximately rectangular housing having a bottom and top wall to which two side walls and a front and rear wall connect. The front wall is provided with an insertion aperture for the plug unit. In the housing resilient contact fingers extend for contacting the plug unit. The contact fingers extend directly or virtually directly in the housing connecting to the insertion aperture in the front wall. For fixing to the outside of the housing in front of the front wall, a panel is provided having a window which in the fitted state connects to the insertion aperture and contains latching means for latching the plug unit onto the socket unit. The panel has an essentially U-shaped cross-section of such size that the latching means lie at a distance from the front wall of the housing when the panel is fitted.

9 Claims, 4 Drawing Sheets

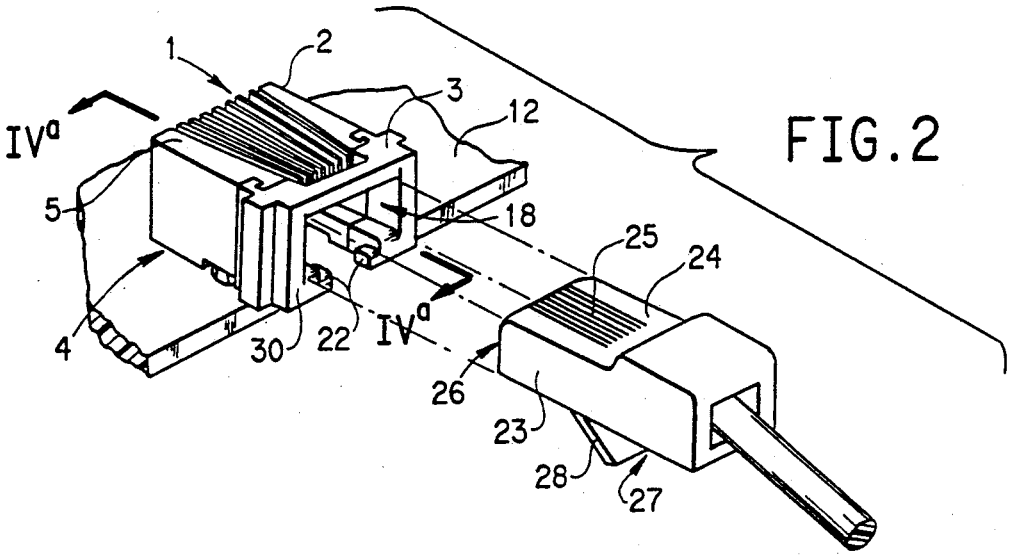
FIG.2
FIG.3B
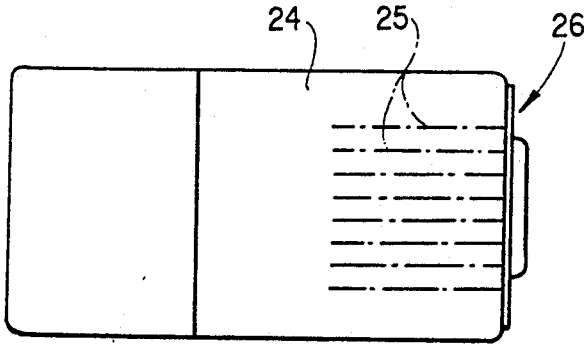
FIG.3C
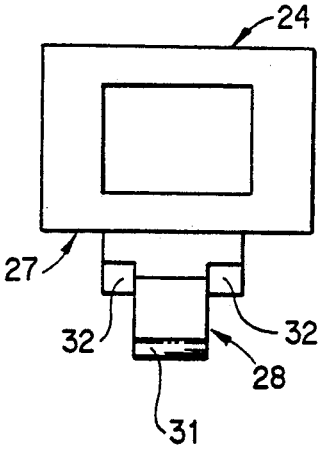
FIG.3A
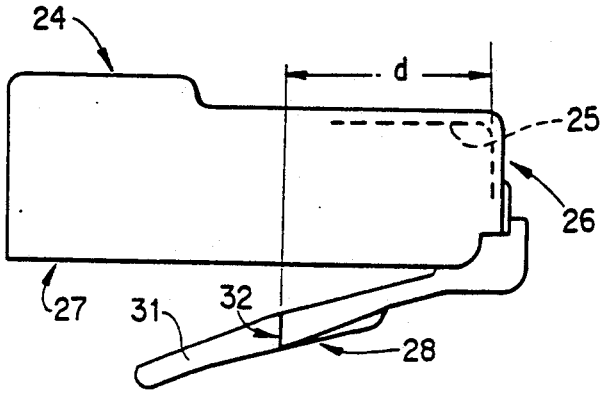

TWO-PART SOCKET UNIT FOR A MODULAR JACK ASSEMBLY

BACKGROUND OF THE INVENTION

The invention relates to a two-part socket unit for receiving and contacting a plug unit of a modular jack assembly of the type for fitting near an edge of a printed circuit board, comprising an approximately rectangular housing having a bottom and top wall to which two side walls and a front and rear wall connect, while at least the front wall is provided with an insertion aperture for the plug unit, with resilient contact fingers extending in the housing for contacting the plug unit, and with a panel to be fixed outside the housing in front of the front wall, provided with a window which in the fitted state connects to the insertion aperture and contains latching means for latching the plug unit on the socket unit.

A two-part socket unit of the above-mentioned type is known from U.S. Pat. Specification No. 4,497,526, in which the panel itself is again made up of two interconnecting parts, which is already a disadvantage from the fitting point of view.

In practice, it is advantageous in terms of assembly and costs to make relatively small printed circuit boards, for example for use in telephone or computer equipment, from a larger board. After the assembly of the various components, such as resistors, capacitors, ICs etc., the larger board is sawn, cut or broken into pieces. However, a problem occurs here in the case of a housing of a modular jack assembly of the present type to be fitted near the edge of a smaller board.

The housing of the known jack assembly when it is fitted projects beyond the edge of the smaller board in question, which to divide the larger board into pieces. On the is often desirable for the housing to project beyond of the board, for example to support it, for positioning, and/or for the accommodation thereof in an aperture of a chassis for aesthetic reasons.

SUMMARY OF THE INVENTION

The object of the invention is to improve the modular jack assembly of the present type in such a way that, on the one hand, the housing of the socket unit can be fitted on a larger printed circuit board without projecting beyond a boundary edge of a smaller board to be formed therefrom and that, on the other hand, a part of the socket unit projecting beyond the edge of a smaller board can be provided, for example for the accommodation thereof in an aperture of a chassis.

According to the invention, this object is achieved in that the contact fingers extend in the housing directly or virtually directly connecting to the insertion aperture in the front wall, and in that the panel has an essentially U-shaped cross-section of such size that the latching means lie at a distance from the front wall of the housing when the panel is fitted.

The housing of the socket unit according to the invention can be fitted entirely within the periphery of a printed circuit board. The above-mentioned distance between the latching means and the front wall of the housing is determined by the stipulated distance between the contact fingers and the latching means in socket units of standard size, viewed in the plug-in direction of the plug unit. This is because the latching elements of the corresponding standard size plug units mating with the latching means of said socket units lie at a stipulated distance from the plug-in side thereof. The selected positioning of the contact fingers according to the invention makes it possible, taking into account the abovementioned standardized distance between the contact fingers and the latching means, to provide a panel of sufficient mechanical sturdiness which after fitting projects a desired distance beyond the edge of the printed circuit board in question, for the accommodation thereof in, for example, an aperture of a chassis.

In the preferred embodiment of the socket unit according to the invention the contact fingers extend in the housing from the outward-facing side of the front wall.

The latching means of the panel can in principle be situated on any desired edge thereof. In practice, socket units in which the latching means are situated on the wall of the housing opposite the contact elements are, however, preferred.

In another embodiment of the invention the contact fingers extend in the housing from the bottom or top wall in the direction away from the insertion aperture towards the top or bottom wall respectively, from which wall a part lying opposite the contact fingers is removed, as is also the part of the panel connecting thereto, for the purpose of forming an accommodation groove for the latching elements of the plug unit when the panel is fitted.

Through this accommodation groove, the overall height of the socket unit is reduced, which is advantageous for use in equipment with compact dimensions.

The socket unit according to the invention also makes it possible, when the unit is fitted on a printed circuit board, to have the latching means projecting beyond the periphery of said board. This means that the latching means of the appropriate plug unit can project at or below the level of the printed circuit board when the jack assembly is in the contacted position, which produces a further saving in the overall height of the jack assembly.

In order to avoid parts projecting beyond the periphery of the panel, which can make it difficult to accommodate the accommodation side of the panel in an aperture of a chassis, in a further embodiment of the invention the latching means comprise lobes projecting into the accommodation groove in the panel from the side for receiving the plug unit.

Many kinds of positive or non-positive connections which are known per se can be used for fixing the panel to the housing. In order to achieve a mechanically stable latching of the plug unit in the socket unit, in yet another embodiment of the invention the side walls of the housing at the side facing outwards are provided with grooves extending from the bottom to the top wall of the housing, for the accommodation in said grooves of correspondingly shaped locking lobes projecting on the inner periphery of the panel.

This design is particularly suitable for absorbing tensile forces in the insertion direction of the jack assembly. Due to the fact that the grooves and the housing extend from the bottom to the top wall, the locking lobes of the panel can be slid easily into the grooves. Another advantage of this design is that the side walls of the housing and the panel connect smoothly to each other.

In an advantageous embodiment, in particular suitable for accommodating the panel in an aperture of a chassis, the panel is provided with stop lobes at a distance from the side for receiving the plug unit, in such a way that a part formed for fitting in an aperture of a chassis is produced.

Although these stop lobes can extend round the entire periphery of the panel, in an embodiment of the invention which is advantageous with a view to limiting the overall height for fitting purposes the size of the panel and the housing, measured at the outer periphery between the bottom and top wall thereof, is the same.

The use of a separate panel provides the possibility of making the socket unit suitable only for taking certain types of plug units, without modifying the design of the housing. This could include, inter alia, plug units which contact a smaller number of contact fingers than those extending in the housing.

The modular jack assemblies of the present type are in general dimensioned for a maximum of eight parallel contact fingers. In order to be able to contact, for example, four or six adjacent contact fingers without the risk of undesired connections, in an embodiment of the invention the size of the window in the panel is smaller than the size of the insertion aperture of the housing, measured between the side walls thereof. The colour of the panel can if necessary be matched to the colour of the chassis or box of an appliance.

The invention also relates to a printed circuit board, provided with a housing according to one or more of the preceding embodiments, and relates to a modular jack assembly, comprising an approximately rectangular plug unit with contact elements extending at one side thereof and latching means situated at the other, opposite side, and a two-part socket unit for receiving and contacting the plug unit, corresponding to one or more of the preceding embodiments.

The invention is explained in greater detail below with reference to a preferred embodiment shown in the drawings.

BRIEF DESCRIPTION OF THE DRAWINGS

FIG. 2 shows schematically a perspective view, on a smaller scale, of the socket unit according to FIG. 1 fitted on a printed circuit board, and a plug unit to be contacted therewith.

FIGS. 3*a, b* and *c* show schematically, on an enlarged scale, the plug unit according to FIG. 2, in side, top and rear view respectively.

DETAILED DESCRIPTION OF THE EMBODIMENT

Figure 1:
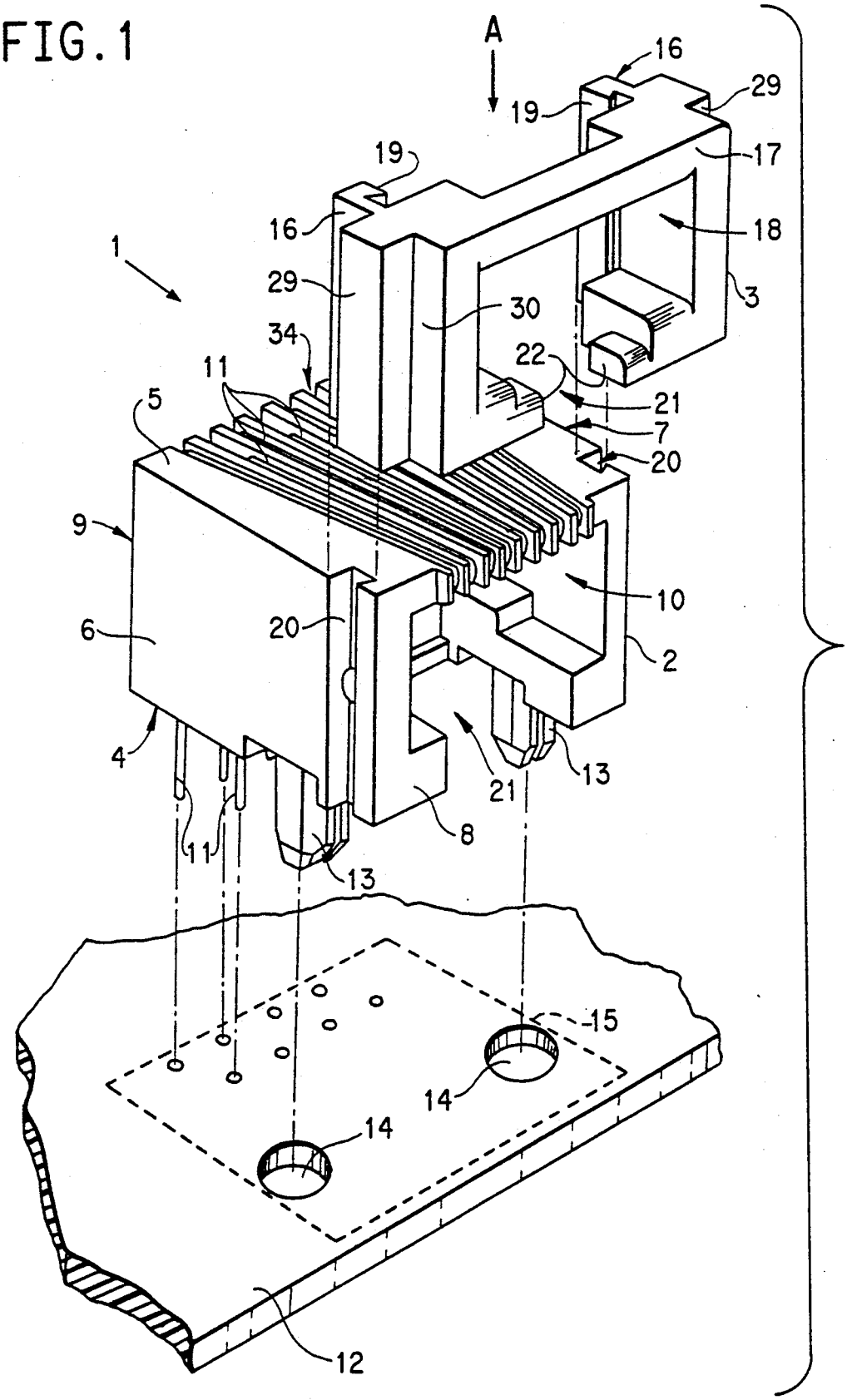
FIG. 1 shows schematically a perspective view of the housing and the panel of the two-part socket unit according to the invention, not fitted.

FIG. 1 shows schematically in perspective the preferred embodiment of the two-part socket unit 1 according to the invention, comprising a housing 2 and a panel 3 to be detachably connected thereto. The housing 2 and the panel 3 are preferably made of plastic. The housing 2 has an approximately rectangular cross-section with a bottom wall 4, a top wall 5, side walls 6 and 7, and a front wall 8 and a rear wall 9. In the embodiment shown, the front wall 8 is provided with an approximately rectangular insertion aperture 10, for receiving a plug unit (not shown).

From the bottom wall 4 of the housing 2 in the rear wall 9 thereof extend contact elements 11 which lead via the top wall 5 to the insertion aperture 10 in the front wall 8, and from here extend as resilient contact fingers in the housing, for contacting thereof by means of a plug unit (not shown).

The ends of the contact elements 11 projecting at the bottom wall 4 of the housing 2 are designed as connecting pins, for electrical connection, for example by means of soldering, to the circuit tracks on a printed circuit board 12. The connecting ends of the contact elements 11 are arranged in two rows staggered relative to each other, as shown. For fixing the housing 2 in a mechanically sturdy manner on the printed circuit board 12, pins 13 project from the bottom wall 4 thereof and fit into correspondingly positioned apertures 14 in the board 12. These pins 13 are dimensioned in such a way that when the unit is fitted they exert a retention force on the wall of an aperture 14 and if necessary on the bottom side of the printed circuit board 12.

The frame 15, indicated by dashed lines on the board 12, corresponds to the periphery of the bottom wall 4 of the housing 2. In this way it is clearly illustrated that the housing 2 when fitted on the printed circuit board 12 extends entirely inside the peripheral edge thereof. After assembly thereof, the board 12 can be formed from a larger board by sawing, cutting or breaking.

According to the invention the panel 3, viewed in the direction of the arrow A, has an essentially U-shaped cross-section, with parallel legs 16 and a base side 17. An approximately rectangular window 18 is provided in the base side 17. The two legs 16 at their free ends merge into trapezium-shaped locking lobes 19 which face each other. Corresponding grooves 20 are provided in the side walls 6, 7 of the housing 2. These grooves 20 extend from the bottom wall 4 to the top wall 5 of the housing 2. The lobes 19 can be slid, for example, from the top wall 5 of the housing 2 into the grooves 20.

As shown, the lobes 19 and the grooves 20 have a slanting side in order to prevent as far as possible the panel 3 from pulling loose through a force in the plug-in direction of the housing 2. Due to the fact that the slanting sides of the grooves 20 are shorter than the rectangular sides thereof, measured between the side walls 6, 7 of the housing, a smooth connection of the legs 16 of the panel 3 to the side walls 6, 7 of the housing 2 is obtained. This design can also act as a so-called click-in connection, in which the lobes 19 can be inserted from the front wall of the housing 2 into the grooves 20. The panel 3 must have a certain resilience for this purpose, in such a way that the two legs 16 can move out from each other. In the case of panels made of thermoplastic material this requirement is generally implicitly met.

In the preferred embodiment of the two-part socket unit according to the invention shown in FIG. 1 the bottom wall 4 is removed along a section from the front wall 8, as shown. The part of the base side 17 of the panel 3 which in the fitted state connects to this part of the bottom wall 4 is also removed. This creates an accommodation groove 21 into which latching lobes 22 on the panel side project, for latching a plug unit thereon. The object of this accommodation groove 21 is to reduce the overall height of the socket unit 1, measured from the board 12 to the top wall 5, as is explained further below.

FIG. 2 shows in perspective, on a smaller scale, the socket unit according to FIG. 1, in the fitted state. It can be seen clearly that the panel 3 projects beyond the edge of the printed circuit board 12. In the state shown the socket unit is suitable for receiving a mating plug unit 23.

The plug unit 23 shown schematically in FIG. 2 has a rectangular cross-section which is adapted to the window 18 of the panel 3. Provided at the top side 24 of the plug unit 23 are contact elements 25, the position of which corresponds to the contact elements in the housing 2 of the socket unit 1. The contact elements 25 can if necessary extend further past the front or insertion side 26 of the plug unit 23. At the bottom side 27 of the plug unit 23 are latching means 28 which act on the latching lobes 22 in the panel 3, in order to latch the plug unit 23 in the inserted position on the socket unit 1.

The latching means 28 of the plug unit 23 in the fitted state are situated in the accommodation groove 21 formed by the recess in the bottom wall 4 of the housing 2 and in the panel 3. This leads to a reduction in the overall height of the modular jack assembly, measured between the printed circuit board 12 and the top wall 5 of the housing 2, all this by comparison with housings in which the bottom wall 4 has no accommodation groove. A further reduction of the overall height can be achieved by also removing the part of the printed circuit board 12 opposite the accommodation groove 21 in the bottom wall 4 of the housing 2. The latching lobes 22 of the panel 3 can then lie below the fitting level of the board 12 on which the components are placed. This is easy to achieve with the embodiment of the socket unit according to the invention, because the latching lobes 22 project beyond the edge of the printed circuit board 12.

The panel 3 is also provided on the legs 16 with outward projecting stop lobes 29, for fitting in an aperture of a chassis (not shown). In the embodiment shown (see FIG. 1) the stop lobes 29 extend from the bottom wall 4 to the top wall 5 of the housing 2. The position of the stop lobes 29 can be selected in such a way that the part 30 of the panel 3 which projects beyond the printed circuit board 12, and in which the window 18 is situated, corresponds in depth to the thickness of the chassis or a box in which the socket unit is fitted. The colour of the panel 3 can also be matched to the colour of the chassis or the box in question. If necessary, it is possible, for example, to provide adjacently fitted socket units with panels of different colours.

FIG. 3*a* shows on an enlarged scale the side view of the plug unit 23 shown in FIG. 2, without connection cable.

The latching means 28 projecting at the bottom side 27 of the plug unit 23 essentially comprise a lip-shaped element 31 of resilient material, FIG. 3*a* showing the rest or initial position. Stops 32, which act on the lobes 22 in the panel 3 (see FIGS. 1, 2) are formed on either side of the part 31. The housing of the plug unit 23 and the latching means 28 are preferably made of thermoplastic material.

FIG. 3*b* shows schematically the view of the top side 24 of the plug unit, in which the parallel contact elements 25 extending herein can be distinguished. In FIG. 3*a* a dashed line indicates that the contact elements 25 extend partially at the front side 26 of the plug unit.

FIG. 3*c* shows the view of the plug unit viewed from the side for receiving the cable. The stops 32 projecting on either side of the lip-shaped part 31 can be seen clearly.

An important parameter for the present invention is the distance (d) between the stop faces 32 and the contact elements 24 at the front or insertion side 26, measured in the lengthwise direction of the plug unit (see FIG. 3*a*). In modular jack assemblies of the present type this distance (d) is standardized.

Figure 4A:
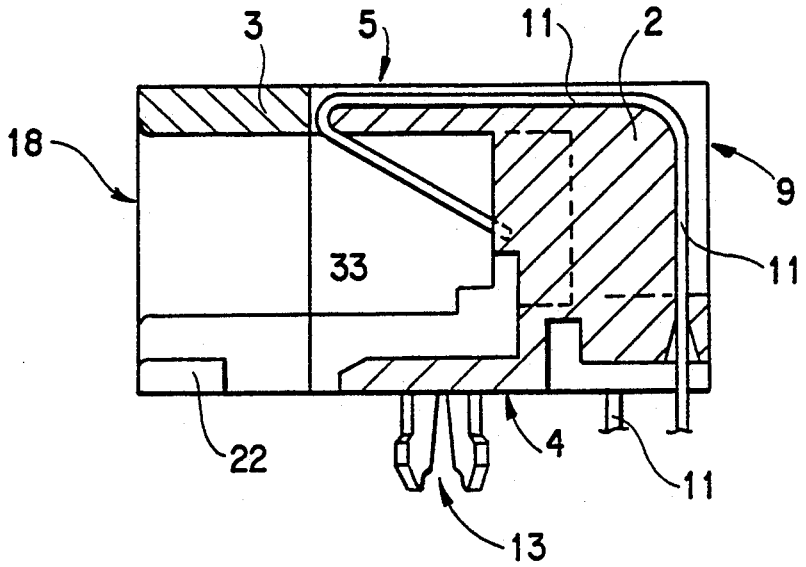
FIGS. 4*a–e* show schematically, on an enlarged scale, a cross-section along the line IV*a*—IV*a* of the socket unit according to FIG. 2, without printed circuit board, the top view of the fitted socket unit, and front views of different embodiments of the panel respectively.

FIG. 4*a* shows a cross-section on an enlarged scale of the fitted socket unit along the line IV*a*—IV*a* in FIG. 2. It can be seen clearly from this that the contact elements 11 according to the invention extend from the front wall 8 in the housing 2 as self-supporting contact fingers 33. In the embodiment shown the contact fingers 33 run from the top wall 5 obliquely in the direction of the bottom wall 4. The contact elements 11 project at the bottom wall 4 for fitting on a printed circuit board. For an expert it is clear that the contact fingers 33 can also extend from the bottom wall 4 in the direction of the top wall 5 in the housing. The ends of the contact elements 11 for fitting on a printed circuit board can if necessary also extend from the top wall 5 or, for example, from the rear wall 9 of the housing.

In the embodiment shown, the fixing pins 13 comprise four fingers which spring away from each other and have a hooked end. When placed in an aperture 14 of a printed circuit board 12, the hooked ends engage with the opposite side of the printed circuit board. For the object of the present application many kinds of fixing means which are known per se are suitable.

It can be seen clearly from the cross-section shown of the socket unit according to the preferred embodiment of the invention that the panel 3 and the housing 2 have the same external periphery. When the socket unit is fitted on a printed circuit board, the latching lobes 22, as a result of the accommodation groove 21 formed in the housing 2 and the panel 3, lie at the level of the printed circuit board on which the housing 2 is mounted with its bottom wall 4. Without such an accommodation groove 21, the lobes 22 would have to lie at a distance above the above-mentioned level of the printed circuit board, which would mean that the overall height of the housing 2 and the panel 3 would have to be correspondingly higher, while if a recess is made in the printed circuit board in question opposite the accommodation groove 21 of the housing 2, the latching lobes 22 can even lie below the above-mentioned level of the printed circuit board. This results, of course, in a lower overall height of the socket unit than shown.

Figure 4B:
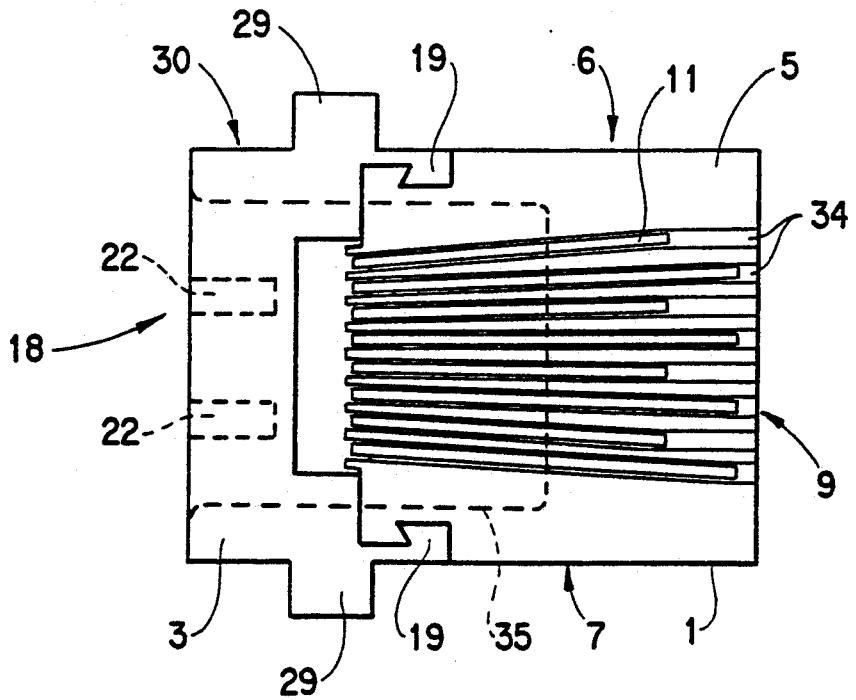

FIG. 4*b* shows the top view of the fitted socket unit. The contact elements 11 extending over the top wall 4 of the housing 2 in grooves 34, and the flush-connecting fixing of the panel 3 to the housing 2 by means of the trapezium-shaped locking lobes 19, and also the stop lobes 29 and the projecting part 30 of the panel 3 thereby formed are all clearly visible. Dashed lines 35 indicate the space for inserting the plug unit into the socket unit. The position of the latching lobes 22 is also indicated by dashed lines.

Figure 4C:
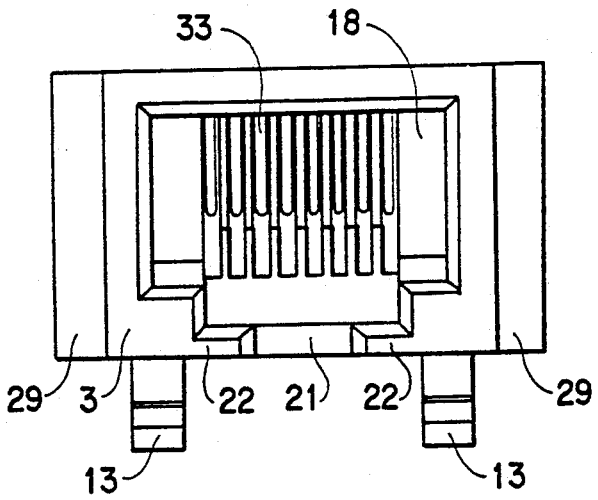

FIG. 4*c* shows the view of the assembled socket unit from the panel 3. In the embodiment shown the window 18 is suitable for taking a plug unit for contacting all contact elements of the socket unit.

Figure 4D:
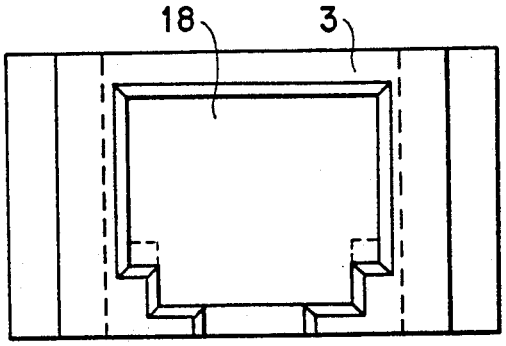
Figure 4E:
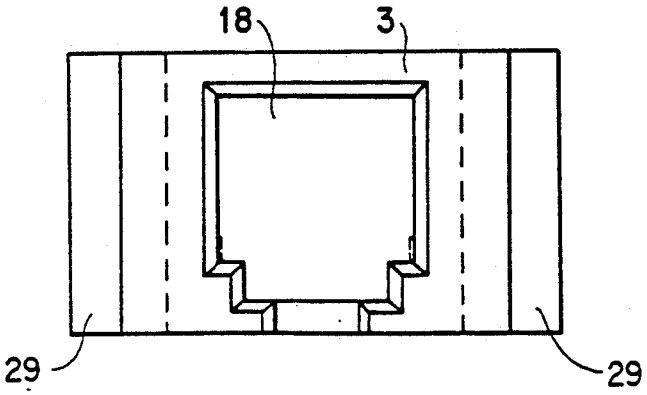

FIGS. 4*d* and 4*e* show schematically in front view embodiments of the panel 3 suitable for taking a plug unit for contacting six contact elements and a plug unit for contacting four contact elements respectively. This shows a major advantage of the present invention, namely that by means of a suitable panel one and the same housing can be made suitable for various plug units.

For an expert many modifications and additions to the socket unit according to the invention are possible without deviating from the idea of the invention, such as, for example, making the housing and the panel suitable for lateral latching of a plug unit, instead of the lock with lobes shown at the level of the bottom wall of the housing, a different fastening of the panel to the housing, for example by laterally placed barbed latching lips, the provision of a further insertion aperture in the rear wall of the housing etc.

I claim:

1. A modular jack socket connector for mounting to a circuit board substrate and adapted for receiving a modular jack plug connector, comprising a housing of insulating material having an approximately rectangular shape with a bottom wall, a top wall, a front wall, a rear wall and two side walls, said front wall being provided with an aperture for receiving said modular jack plug connector, a plurality of resilient, electrically conductive contact fingers extending in the housing for electrically contacting corresponding contacts on said plug connector, and a panel adapted for detachable connection to said housing adjacent said front wall, said panel being provided with locking lobes along each side which are adapted to be received in corresponding grooves formed along each side wall of the housing adjacent the front wall to enable said panel to slidingly engage with said housing, said panel also provided with a window and latching means adjacent said window for detachably latching the plug connector with socket, whereby when the panel is connected to the housing, said window aligns with the aperture of the housing and said latching means are spaced from the front wall of the housing.

2. The modular jack socket connector of claim 1, wherein the panel is provided with stop lobes at a distance from the side for receiving the connector plug, in such a way that a part formed for fitting in an aperture of a chassis is produced.

3. The modular jack socket connector of claim 1, wherein the size of the panel and the housing, measured at the outer periphery between the bottom and top wall thereof, is the same.

4. The modular jack socket connector of claim 1, wherein the size of the window is the panel is smaller than the size of the aperture of the housing, measured between the side walls thereof.

5. A printed circuit board provided with a modular jack socket connector according to claim 1, wherein the housing lies within the periphery of the board of an edge thereof.

6. A modular jack assembly, comprising an approximately rectangular plug connector with contact elements extending at one side thereof and latching means situated at the other, opposite side, and a modular jack socket according to claim 1, for receiving and contacting the plug connector.

7. The modular jack socket connector of claim 1, wherein the contact hinges extend into the aperture of the housing from the front wall.

8. The modular jack socket connector of claim 1, wherein the contact fingers extend into the housing from the bottom or top wall in the direction away from the aperture towards the top or bottom wall respectively, from which wall a part lying opposite the contact fingers is removed, as is also the part of the panel connecting thereto, for the purpose of forming an accommodation groove for the latching elements of the plug connector when the panel is fitted.

9. The modular jack socket connector claim 8, wherein the latching means comprise lobes projecting into the accommodation groove in the panel from the side for the accommodation of the connector plug.

* * * * *